US010661307B2

(12) United States Patent
Nakazono et al.

(10) Patent No.: US 10,661,307 B2
(45) Date of Patent: May 26, 2020

(54) METHOD AND SYSTEM FOR USE IN APPLYING A COATING MATERIAL TO A VEHICLE

(71) Applicant: Honda Motor Co., Ltd., Tokyo (JP)

(72) Inventors: Daisuke Nakazono, Dublin, OH (US); John Jeffrey Carter, Marysville, OH (US); Kevin Michael Wilkens, Hilliard, OH (US); Jason John Potuzko, Dublin, OH (US); Steven Lynn Haycox, Edison, OH (US); Hiroko Kimoto, Utsunomiya (JP); Akira Suzuki, Suzuka (JP)

(73) Assignee: Honda Motor Co., Ltd., Tokyo (JP)

( * ) Notice: Subject to any disclaimer, the term of this patent is extended or adjusted under 35 U.S.C. 154(b) by 104 days.

(21) Appl. No.: 15/449,134

(22) Filed: Mar. 3, 2017

(65) Prior Publication Data

US 2018/0250703 A1 Sep. 6, 2018

(51) Int. Cl.
*B05D 7/14* (2006.01)
*B05D 7/00* (2006.01)
(Continued)

(52) U.S. Cl.
CPC ..... *B05D 7/14* (2013.01); *B05B 13/0431* (2013.01); *B05D 1/02* (2013.01); *B05D 7/53* (2013.01); *B05B 13/0452* (2013.01)

(58) Field of Classification Search
None
See application file for complete search history.

(56) References Cited

U.S. PATENT DOCUMENTS 4,919,977 A * 4/1990 Yamane ..... B05B 13/0221 427/379
6,440,218 B1 8/2002 Sanada et al.
(Continued)

FOREIGN PATENT DOCUMENTS

CN 103433183 A 12/2013
JP S6034770 A 2/1985
(Continued)

OTHER PUBLICATIONS

Anandan, Tanya M.; "The Art of Industrial Painting with Robots"; Robotic Industries Association; Oct. 7, 2013; available at https://www.robotics.org/content-detail.cfm/Industrial-Robotics-Industry-Insights/The-Art-of-Industrial-Painting-with-Robots/content_id/4447; last visited Sep. 12, 2018.
(Continued)

*Primary Examiner* — Michael P. Rodriguez
(74) *Attorney, Agent, or Firm* — Armstrong Teasdale LLP

(57) ABSTRACT

A method of applying a coating material to a vehicle that includes defining a plurality of application zones on the vehicle. The application zones include a low visibility zone, a medium visibility zone, and a high visibility zone. The method further includes applying the coating material to the application zones in a predetermined sequence such that a first portion of the coating material is applied to the low visibility zone, then a second portion is applied to the medium visibility zone, and then a third portion is applied to the high visibility zone. A first overlap region is defined between the low visibility zone and the high visibility zone and a second overlap region is defined between the medium visibility zone and the high visibility zone. The third portion of the coating material is applied before the coating material previously applied in the first and second overlap regions has set for a predefined duration.

13 Claims, 5 Drawing Sheets

(51) Int. Cl.
*B05B 13/04* (2006.01)
*B05D 1/02* (2006.01)

(56) References Cited

U.S. PATENT DOCUMENTS

| | | | | |
|---|---|---|---|---|
| 6,447,847 | B1 | 9/2002 | Hynes et al. | |
| 7,691,450 | B2 | 4/2010 | Kenmoku et al. | |
| 7,798,094 | B2 | 9/2010 | Meissner | |
| 7,927,669 | B2 | 4/2011 | Schlatterbeck et al. | |
| 8,434,958 | B2 | 5/2013 | Rademacher | |
| 8,644,989 | B2 | 2/2014 | Rademacher et al. | |
| 8,783,210 | B2 | 7/2014 | Takayama et al. | |
| 8,846,155 | B2 | 9/2014 | Herre et al. | |
| 9,302,286 | B2 | 4/2016 | Morton | |
| 2003/0017276 | A1* | 1/2003 | Yamada | B05B 12/16 427/467 |
| 2004/0115359 | A1* | 6/2004 | Cebola | B05B 12/00 427/9 |
| 2014/0220231 | A1 | 8/2014 | Fischer et al. | |
| 2014/0234011 | A1 | 8/2014 | Tomuta et al. | |
| 2014/0329001 | A1 | 11/2014 | Rouaud et al. | |
| 2015/0147460 | A1 | 5/2015 | Manzi et al. | |
| 2016/0121367 | A1 | 5/2016 | Hwang | |

FOREIGN PATENT DOCUMENTS

| | | | |
|---|---|---|---|
| JP | S61216772 | A | 9/1986 |
| JP | H1199360 | A | 4/1994 |
| JP | H10244211 | A | 9/1998 |
| JP | 2002079174 | A | 3/2002 |
| JP | 2006007107 | A | 1/2006 |
| JP | 2011115763 | A | 6/2011 |
| JP | 2012196587 | A | 10/2012 |
| JP | 2012254448 | A | 12/2012 |
| JP | 2015221418 | A | 12/2015 |

OTHER PUBLICATIONS

IPO Combined Search and Examination Report for related application GB1803112.0 dated Aug. 15, 2018; 12 pp.
DE Search Report and Office Action for related application 102018202463.4 dated Oct. 25, 2018; 32 pp.
CA Examiner's Report for related application 2,994,762 dated Jan. 17, 2019; 4 pp.
English translation of JP Notice of Reasons for Rejection for related application 2018-037246 dated Feb. 26, 2019; 3 pp.

* cited by examiner

METHOD AND SYSTEM FOR USE IN APPLYING A COATING MATERIAL TO A VEHICLE

BACKGROUND

The field of the present disclosure relates generally to a method and system for use in applying a coating to a vehicle and, more specifically, to a clear coat application sequence and pattern.

At least some known vehicles, such as automobiles, are manufactured from a plurality of body panels that define the hood, fenders, roof, trunk, and doors of a vehicle, for example. The body panels are typically manufactured separately from each other and attached to a frame, and the body panels are then coated with a plurality of layers of material. Example layers of material include, but are not limited to, at least one layer of a paint material and at least one layer of a clear coat material. The paint material, which may also be referred to as a base coat, provides the vehicle color. The layer of clear coat material is the outermost layer of material applied to the vehicle, and facilitates enhancing the overall appearance of the vehicle. The layer of clear coat material is typically applied to the vehicle in a predetermined spray pattern.

A greater thickness of clear coat material is often considered to provide a more desirable vehicle appearance. For example, a greater thickness of clear coat material may be described as providing an automotive finish having a more desirable depth than that provided by a lesser thickness of clear coat material. To achieve a greater thickness of clear coat material, without introducing clear coat flaws such as sagging or dripping, multiple layers of clear coat material may be applied. For example, a first portion of clear coat material may be applied, allowed to dry/cure for some amount of time, and a second portion of clear coat material may be applied over the first portion. Sanding may also be performed between layers of clear coat to eliminate flaws. The added process steps of applying multiple layers of clear coat and sanding add to the expense of the automotive finish when compared to a single coat application of the clear coat material.

BRIEF DESCRIPTION

In one aspect, a method of applying a coating material to a vehicle is provided. The method includes defining a plurality of application zones on the vehicle including a low visibility zone, a medium visibility zone, and a high visibility zone. The method further includes applying the coating material to the plurality of application zones in a predetermined sequence such that a first portion of the coating material is applied to the low visibility zone, then a second portion of the coating material is applied to the medium visibility zone, and then a third portion of the coating material is applied to the high visibility zone. A first overlap region is defined between the low visibility zone and the high visibility zone and a second overlap region is defined between the medium visibility zone and the high visibility zone. In addition, the third portion of the coating material is applied before the coating material previously applied in the first overlap region and the second overlap region has set for a predefined duration.

In another aspect, a system for use in applying a coating material to a vehicle is provided. The system includes a plurality of robotic spray devices including a first robotic spray device configured to apply at least one of a first portion of the coating material and a second portion of the coating material to the vehicle. The first portion is applied to a low visibility zone of the vehicle and the second portion is applied to a medium visibility zone of the vehicle. A second robotic spray device is configured to apply a third portion of the coating material to a high visibility zone of the vehicle. The system further includes a controller coupled in communication with the plurality of robotic spray devices. The controller is configured to actuate the plurality of robotic spray devices such that the coating material is applied in a predetermined sequence, wherein the first portion is applied to the low visibility zone and the second portion is applied to the medium visibility zone, and then the third portion is applied to the high visibility zone. A first overlap region is defined between the low visibility zone and the high visibility zone and a second overlap region is defined between the medium visibility zone and the high visibility zone, and the third portion of the coating material is applied before the coating material previously applied in the first overlap region and the second overlap region has set for a predefined duration.

DETAILED DESCRIPTION

The embodiments described herein relate generally to a clear coat application sequence and pattern. More specifically, the clear coat application sequence and pattern described herein facilitates application of a clear coat material on a vehicle at a greater thickness than that which is typically achieved with other known clear coat material applied in single pass application processes. To achieve the greater thickness, without increasing imperfections such as sagging or drips, a higher viscosity and faster drying clear coat material is applied to the vehicle in a predetermined sequence. For example, the method described herein includes defining the vehicle into three distinct application zones, where each zone is ranked based on perceptibility or visibility to an observer exterior of the vehicle (e.g., zones more frequently and easily viewed are ranked higher than those that are less frequently viewed). The predetermined sequence includes applying the clear coat material to the lower ranked application zones before application of the clear coat to the higher ranked application zone(s). It has been found that overspray affects the overall appearance of the vehicle more than underspray. For example, in a spray overlap region defined between adjacent zones, underspray from the lower ranked zone applied under the coating material in the higher ranked zone affects the appearance of the clear coat less than having overspray from the lower ranked zone applied over coating material in the higher ranked zone. As such, the system and method described herein facilitate achieving the greater thickness layer of clear coat material with an improved overall appearance for the vehicle.

Figure 1:
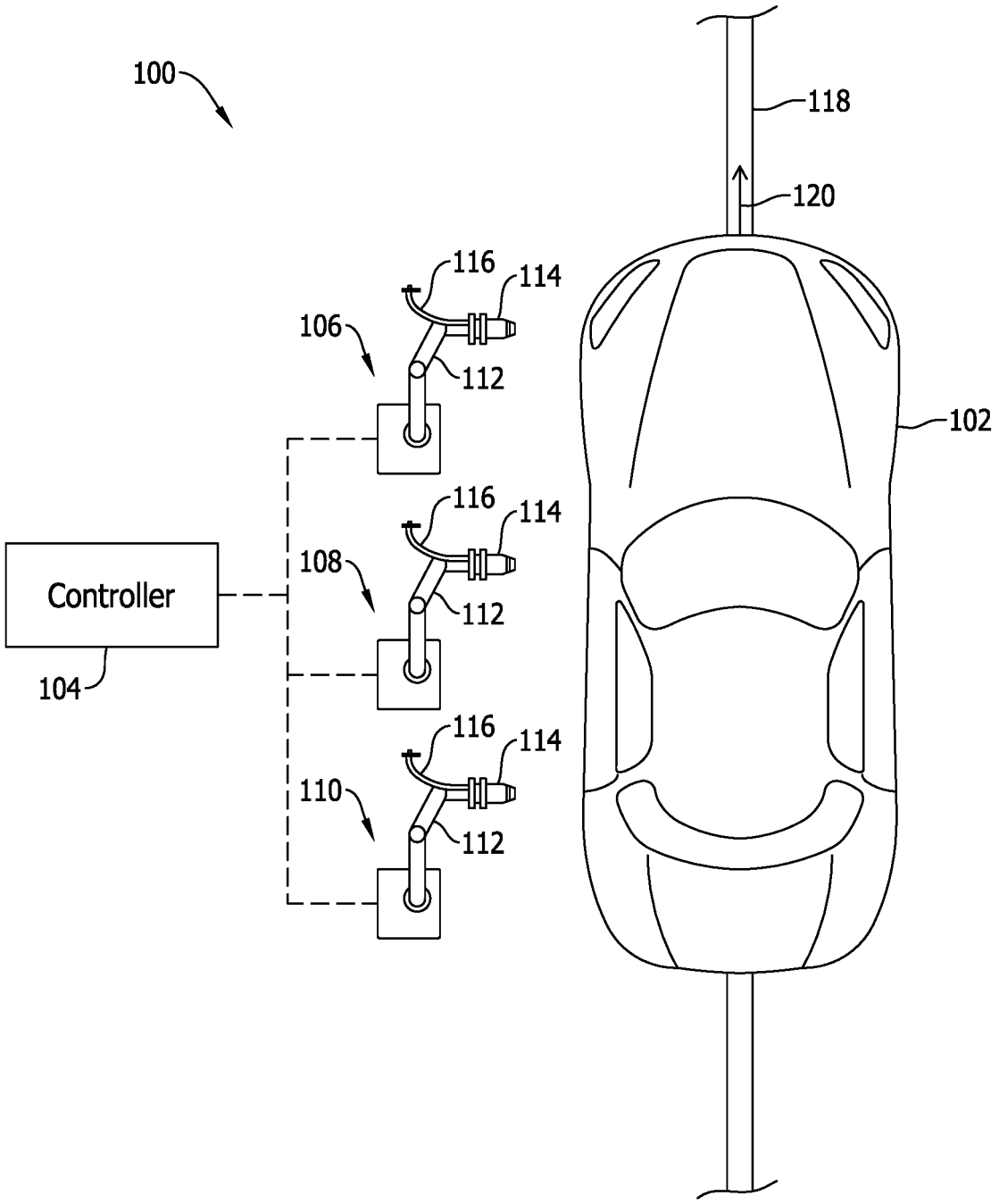
FIG. 1 is an illustration of an exemplary system that may be used to apply a coating material to a vehicle.

FIG. 1 is an illustration of an exemplary system 100 that may be used to apply a coating material to a vehicle 102. In the exemplary embodiment, system 100 includes a plurality of robotic spray devices and a controller 104 coupled in communication with the plurality of robotic spray devices. More specifically, the plurality of robotic spray devices includes a first robotic spray device 106, a second robotic spray device 108, and a third robotic spray device 110. Each robotic spray device includes a robotic arm 112, an applicator head 114, and a supply line 116 that provides the coating material to applicator head 114. As will be explained in more detail below, during a coating application process, controller 104 actuates the plurality of robotic spray devices for applying a portion of the coating material on vehicle 102 in a predetermined sequence. In an alternative embodiment, as will be described in more detail below, the plurality of robotic spray devices includes two robotic spray devices.

The robotic spray devices apply any coating material to vehicle 102 that enables system 100 to function as described herein. An exemplary coating material includes, but is not limited to, a clear coat material including a resin and a catalyst. In an exemplary embodiment, the resin includes a) a high speed evaporation solvent; and b) a rheology control agent. Alternatively, a one component clear coat material having similar attributes may be applied. In one embodiment, the coating material is applied at a thickness greater than about 45 microns. Alternatively, or additionally, the coating material is applied at a thickness of up to about 80 microns.

System 100 further includes a conveyor line 118 coupled to vehicle 102. Conveyor line 118 facilitates translating vehicle 102 in a forward direction 120 past the plurality of robotic spray devices. As such, the system described herein is capable of applying the coating material to multiple vehicles in a continuous and sequential manner. Moreover, while depicted as a two-door coupe, it should be understood that the systems and methods described herein are applicable to any type of vehicle, as will be shown in more detail below.

Figure 2:
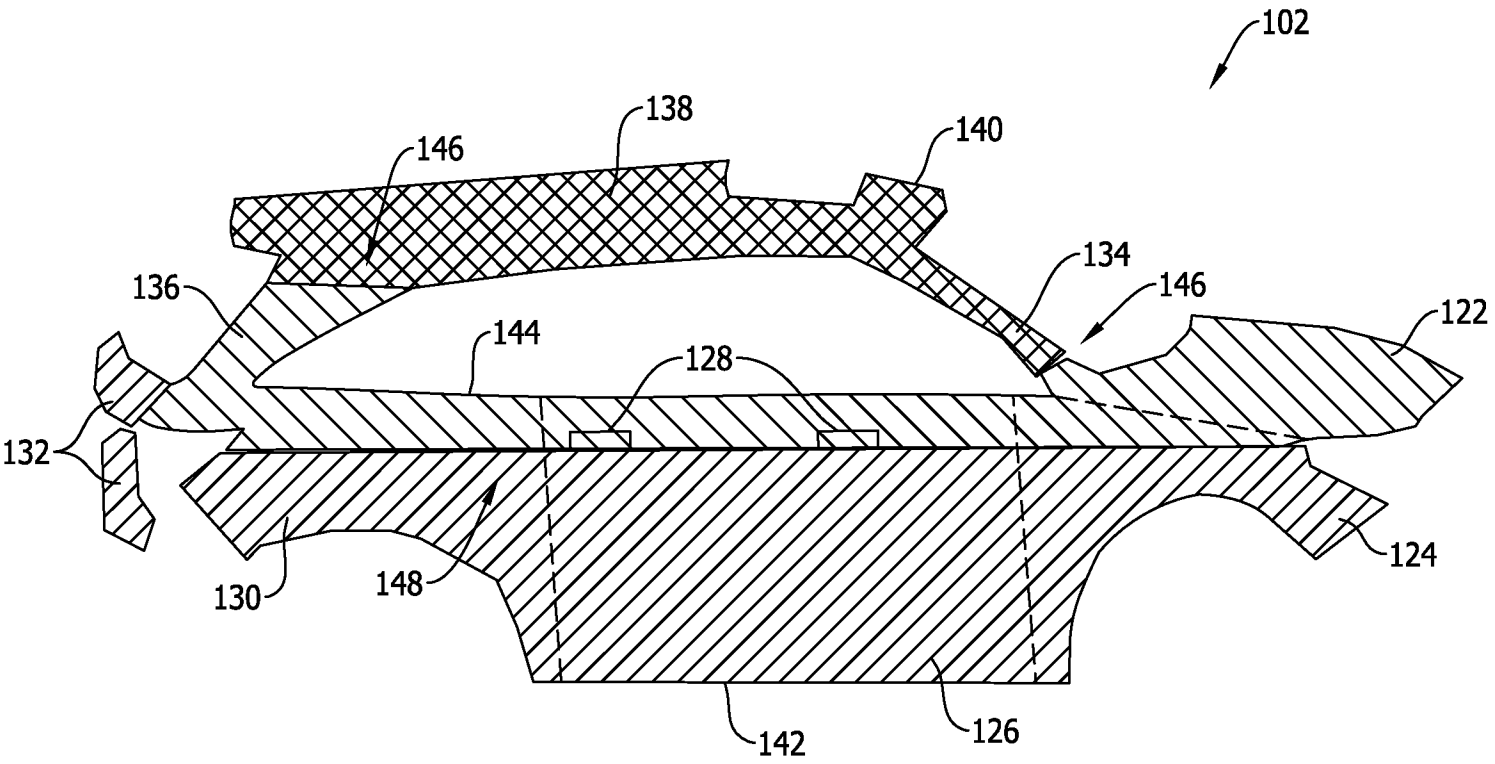
FIG. 2 is an illustration of an exemplary arrangement of application zones that may be defined on a vehicle.
Figure 3:
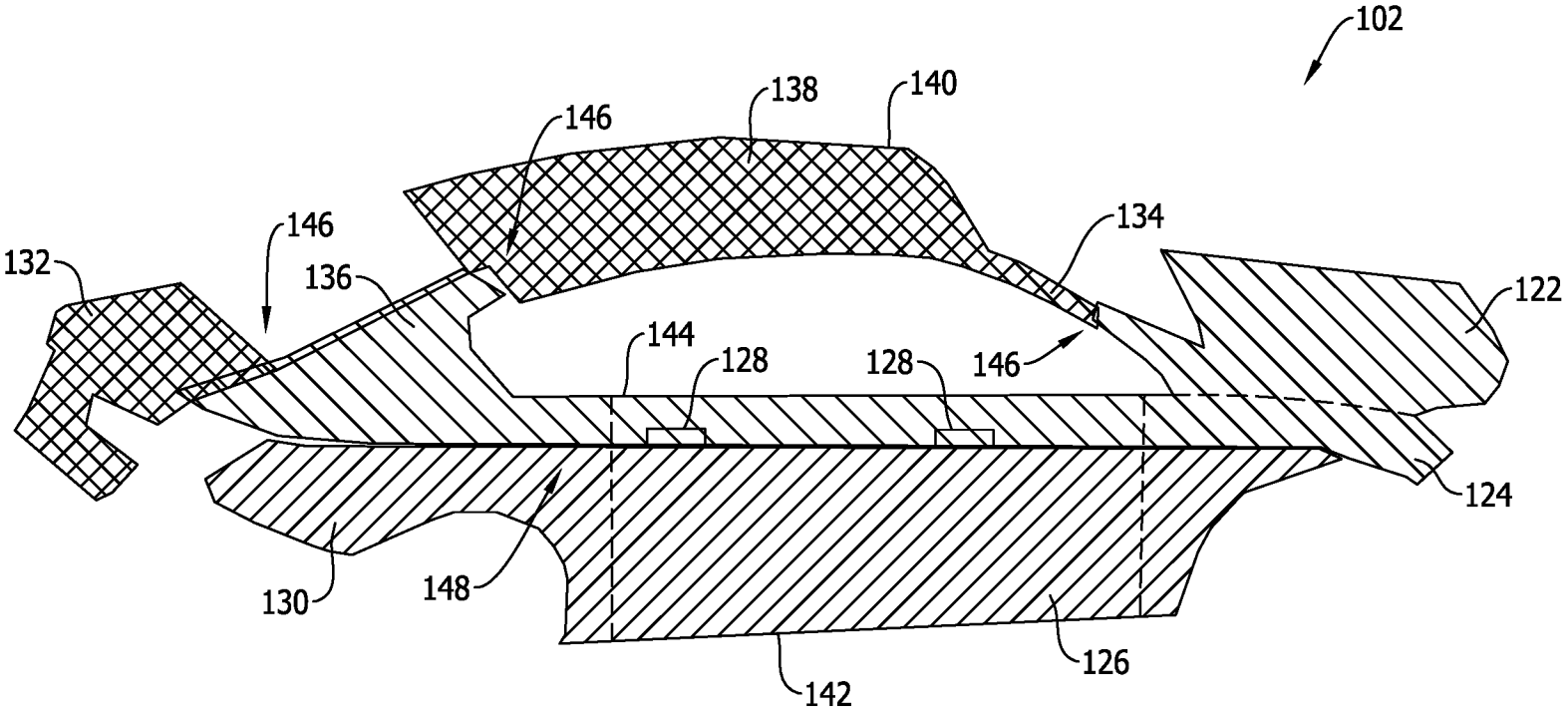
FIG. 3 is an illustration of an alternative arrangement of application zones that may be defined on a vehicle.
Figure 4:
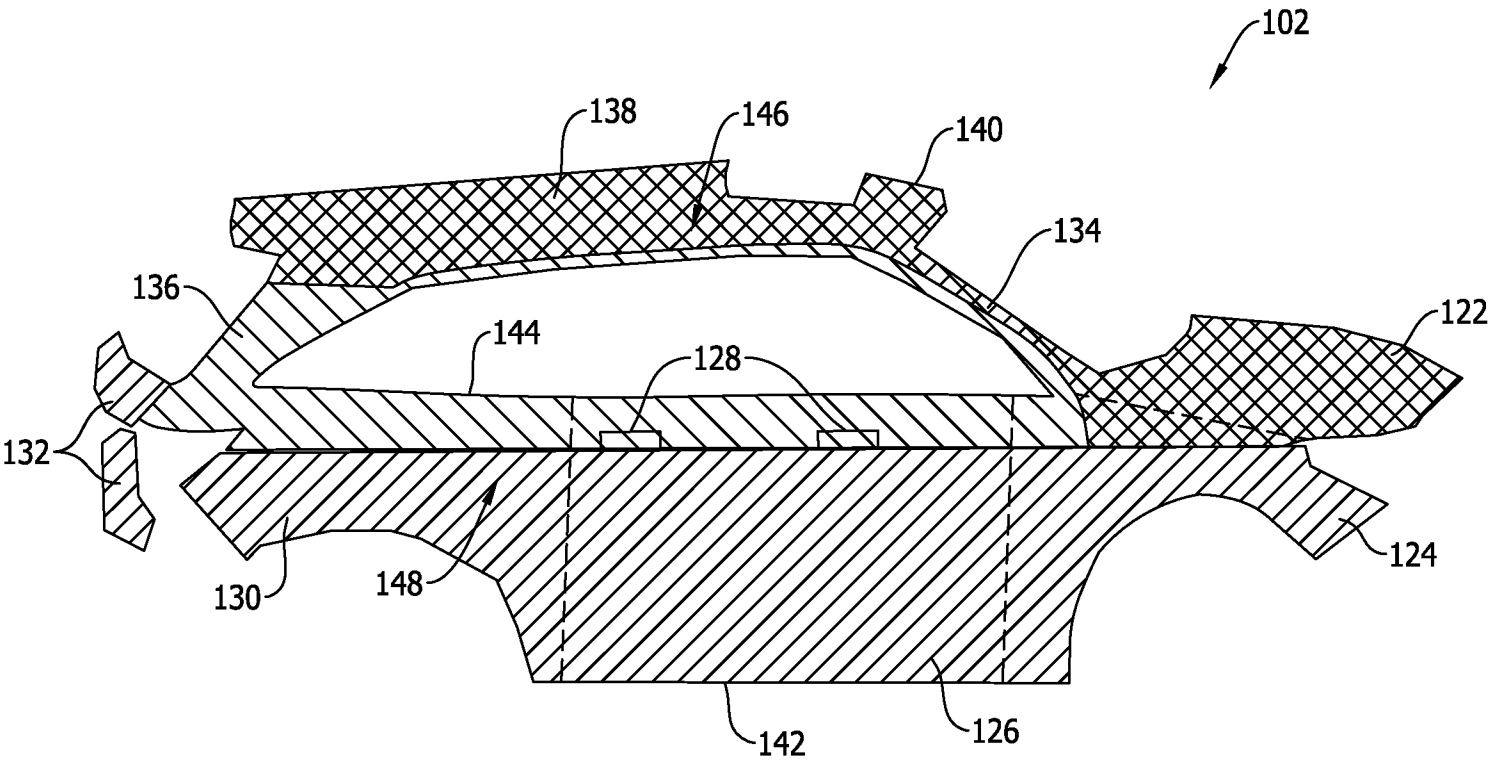
FIG. 4 is an illustration of another alternative arrangement of application zones that may be defined on a vehicle.

FIGS. 2-4 are illustrations of arrangements of application zones that may be defined on vehicle 102. In the exemplary embodiment, vehicle 102 includes a plurality of parts such as, but not limited to, a hood 122, a front quarter 124, at least one door 126, at least one door handle 128, a rear quarter 130, a trunk 132, a front pillar 134, a rear pillar 136, and a roof 138. In addition, the method described herein includes defining a plurality of application zones on vehicle 102, where the plurality of application zones include one or more of the parts identified above. For example, the plurality of application zones include a low visibility zone 140, a medium visibility zone 142, and a high visibility zone 144. As described above, the plurality of application zones are defined based on the perceptibility or visibility to an observer exterior of vehicle 102. As such, the parts included in each application zone varies based on the type of vehicle being coated, for example. In addition, in some embodiments, the parts are interchangeable between the plurality of application zones, or the plurality of application zones include only portions of each part.

For example, referring to FIG. 2, low visibility zone 140 includes roof 138 and a portion of front pillar 134. Medium visibility zone 142 includes lower portions of front quarter 124, door 126, rear quarter 130, and trunk 132. High visibility zone 144 includes hood 122 and upper portions of front quarter 124, door 126, rear quarter 130, and rear pillar 136.

Referring to FIG. 3, low visibility zone 140 includes a portion of front pillar 134, trunk 132, and roof 138. Medium visibility zone 142 includes lower portions of front quarter 124, door 126, and rear quarter 130. High visibility zone 144 includes hood 122, a portion of front pillar 134, upper portions of front quarter 124, door 126, and rear quarter 130, and rear pillar 136.

Referring to FIG. 4, low visibility zone 140 includes hood 122, an upper portion of front quarter 124, a portion of front pillar 134, and roof 138. Medium visibility zone 142 includes lower portions of front quarter 124, door 126, rear quarter 130, and trunk 132. High visibility zone 144 includes upper portions of front quarter 124, door 126, and rear quarter 130, rear pillar 136, and a lower portion of roof 138.

As such, in summary, at least some of the parts, or portions thereof, identified above are typically more readily visible to an observer exterior of vehicle 102, such that high visibility zone 144 is defined to extend over the readily visible parts. For example, in the exemplary embodiments, high visibility zone 144 is defined to extend over door handle 128 on vehicle 102, and defined to extend over at least a portion of front pillar 134 or rear pillar 136.

In addition, when applying the coating material to vehicle 102, spray overlap occurs between the plurality of application zones. As such, a first overlap region 146 is defined between low visibility zone 140 and high visibility zone 144, and a second overlap region 148 is defined between medium visibility zone 142 and high visibility zone 144. As will be described in more detail below, system 100 (shown in FIG. 1) applies portions of the coating material to the plurality of application zones in a predetermined sequence such that portions of the coating material previously applied to vehicle 102 in first overlap region 146 and second overlap region 148 set for no longer than a predefined duration before application of a subsequent portion. At a certain length of time after the clear coat material is applied to the vehicle, referred to hereinafter as a first drying time, the clear coat material dries to a point where subsequently applied material (i.e., overspray) will not blend with the previously applied material. The predetermined duration of time is a length of time that is less than the first drying time. Maintaining the duration of time that clear coat material is on the vehicle and when additional clear coat material (i.e., overspray) may contact the previously applied clear coat material below the predetermined duration of time ensures that overspray blends with previously applied material to achieve the desired appearance.

For example, in operation, first robotic spray device 106 (shown in FIG. 1) applies a first portion of the coating material to low visibility zone 140, second robotic spray device 108 (shown in FIG. 1) applies a second portion of the coating material to medium visibility zone 142, and third robotic spray device 110 (shown in FIG. 1) applies a third portion of the coating material to high visibility zone 144. Controller 104 (shown in FIG. 1) actuates first robotic spray device 106, second robotic spray device 108, and third robotic spray device 110 such that the coating material is applied in a predetermined sequence. More specifically, controller 104 actuates the plurality of robotic spray devices such that the first portion is applied to low visibility zone 140, then the second portion is applied to medium visibility zone 142, and then the third portion is applied to high visibility zone 144. In addition, controller 104 actuates third robotic spray device 110 at a time such that the third portion of coating material is applied before the coating material previously applied in first overlap region 146 and second overlap region 148 has set for a predefined duration. As such, the third portion is applied before the coating material previously applied has time to dry, thereby reducing the effect of overspray and underspray in first overlap region 146 and second overlap region 148 on the overall appearance of vehicle 102.

For example, in one embodiment, controller 104 actuates third robotic spray device 110 such that the third portion of the coating material is applied at first overlap region 146 before the first portion in first overlap region 146 has set for a first predefined duration. In addition, controller 104 actuates third robotic spray device 110 such that the third portion of the coating material is applied at second overlap region 148 before the second portion in second overlap region 148 has set for a second predefined duration. In the exemplary embodiment, controller 104 actuates third robotic spray device 110 at a time such that the first predefined duration is less than about 90 seconds, and such that the second predefined duration is less than about 45 seconds. As such, the effect of overspray or underspray in second overlap region 148 (i.e., in areas of high visibility) is reduced, and the effect of overspray or underspray in first overlap region 146 is greater than in second overlap region 148, but is less noticeable than in the high visibility areas.

In some embodiments, controller 104 also actuates second robotic spray device 108 before application of the first portion by first robotic spray device 106 is complete, and actuates third robotic spray device 110 before application of at least one of the first portion by first robotic spray device 106 or the second portion by second robotic spray device 108 is complete. As such, third portion is applied before the coating material previously applied is allowed to set for more than the first predefined duration and the second predefined duration when an application time for the first portion and the second portion is greater than the respective predefined durations.

Moreover, in some embodiments, the plurality of application zones are defined on a side half of vehicle 102. As such, the application times for the first portion, the second portion, and the third portion are reduced, which facilitates reducing the effect of overspray or underspray in first overlap region 146 and second overlap region 148.

Figure 5:
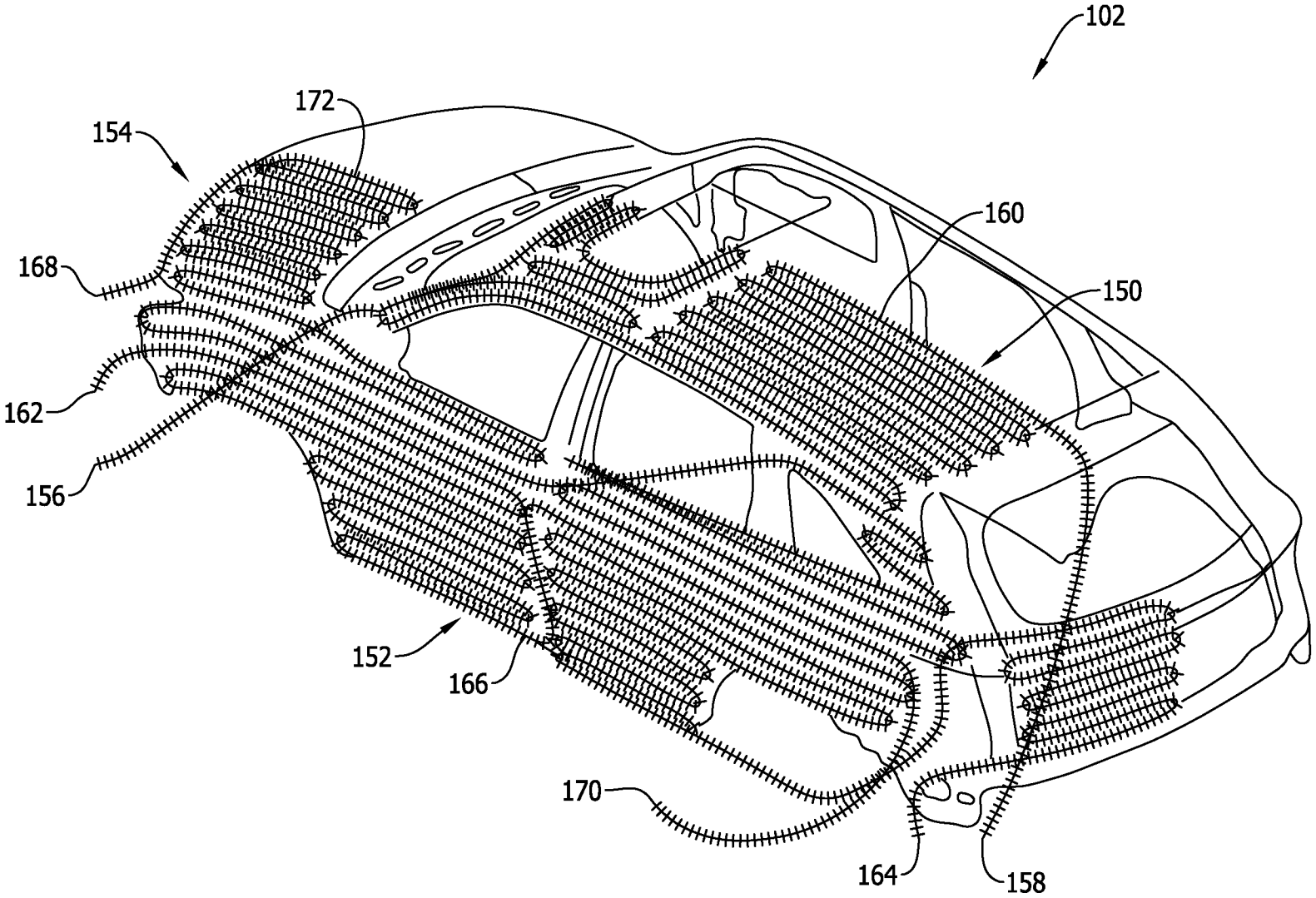
FIG. 5 is an illustration of exemplary application tool paths that may be used by the system shown in FIG. 1.

FIG. 5 is an illustration of exemplary application tool paths that may be used by system 100 (shown in FIG. 1). In the exemplary embodiment, the application tool paths include a first tool path 150 defined for execution by first robotic spray device 106 (shown in FIG. 1), a second tool path 152 defined for execution by second robotic spray device 108 (shown in FIG. 1), and a third tool path 154 defined for execution by third robotic spray device 110 (shown in FIG. 1). More specifically, first tool path 150 is defined by a first starting point 156, a first end point 158, and a first continuous application pattern 160 defined therebetween. Similarly, second tool path 152 is defined by a second starting point 162, a second end point 164, and a second continuous application pattern 166 defined therebetween, and third tool path 154 is defined by a third starting point 168, a third end point 170, and a third continuous application pattern 172 defined therebetween. As such, the coating material is applied to uncoated portions of vehicle 102 in a single application pass.

As noted above, in an alternative embodiment, system 100 includes two robotic spray devices. In the alternative embodiment, the first robotic spray device applies the first portion of the coating material to vehicle 102 and the second portion of the coating material to vehicle 102. The first portion is applied to low visibility zone 140 and the second portion is applied to medium visibility zone 142. For example, the first robotic spray device executes first tool path 150 and then second tool path 152. Alternatively, the first robotic spray device applies the first portion and the second portion of the coating material using a tool path that traverses both low visibility zone 140 and medium visibility zone 142. The second robotic spray device of the two robotic spray devices then applies the third portion of the coating material to high visibility zone 144. In a further alternative embodiment, system 100 includes any number of robotic devices that enables system 100 to function as described herein, such as including four robotic spray devices.

This written description uses examples to disclose various embodiments, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of applying a coating material to a vehicle, said method comprising:

defining a plurality of application zones on the vehicle, the plurality of application zones including a low visibility zone including at least a portion of a roof of the vehicle, a medium visibility zone including at least a lower portion of a door of the vehicle, and a high visibility zone between the low and medium visibility zones; and applying the coating material that is a clear coat material to the plurality of application zones in a predetermined sequence such that a first portion of the coating material is applied to the low visibility zone, then a second portion of the coating material is applied to the medium visibility zone, and then a third portion of the coating material is applied to the high visibility zone, wherein a first overlap region is defined between the low visibility zone and the high visibility zone and a second overlap region is defined between the medium visibility zone and the high visibility zone, wherein at least some of each portion does not overlap with the other portions in the respective visibility zones, and wherein the third portion of the coating material is applied before the coating material previously applied in the first overlap region and the second overlap region has set for a predefined duration.

2. The method in accordance with claim 1, wherein defining a plurality of application zones comprises defining the plurality of application zones on a side half of the vehicle.

3. The method in accordance with claim 1, wherein defining a plurality of application zones comprises defining the high visibility zone to extend over a door handle on the vehicle.

4. The method in accordance with claim 1, wherein defining a plurality of application zones comprises defining the high visibility zone to extend over at least a portion of a pillar of the vehicle.

5. The method in accordance with claim 1, wherein applying the coating material comprises:

applying the third portion of the coating material at the first overlap region before the first portion in the first overlap region has set for a first predefined duration; and applying the third portion of the coating material at the second overlap region before the second portion in the second overlap region has set for a second predefined duration.

6. The method in accordance with claim 5, wherein applying the third portion of the coating material at the first overlap region comprises applying the third portion such that the first predefined duration is less than about 90 seconds.

7. The method in accordance with claim 5, wherein applying the third portion of the coating material at the second overlap region comprises applying the third portion such that the second predefined duration is less than about 45 seconds.

8. The method in accordance with claim 1, wherein applying the coating material comprises applying the coating material at a thickness greater than about 45 microns.

9. The method in accordance with claim 1, wherein applying the coating material comprises applying the coating material at a thickness of up to about 80 microns.

10. The method in accordance with claim 1, wherein applying the coating material comprises applying the coating material to uncoated portions of the vehicle in a single application pass.

11. The method in accordance with claim 10, wherein applying the coating material to uncoated portions of the vehicle in a single application pass comprises applying the coating material in a continuous application pattern.

12. The method in accordance with claim 1, wherein applying the coating material comprises applying each of the first portion, the second portion, and the third portion from a different application source.

13. The method in accordance with claim 1, wherein applying the coating material comprises:

initiating application of the second portion before application of the first portion is complete; and initiating application of the third portion before application of at least one of the first portion or the second portion is complete.

* * * * *